United States Patent [19]

Trame

[11] 4,021,944

[45] May 10, 1977

[54] DISPLAY DEVICE WITH ORBITALLY MOVABLE PLATES

[75] Inventor: Charles E. Trame, Fox Point, Wis.

[73] Assignee: Everbrite Electric Signs, Inc., South Milwaukee, Wis.

[22] Filed: May 3, 1976

[21] Appl. No.: 682,939

[52] U.S. Cl. ..... 40/28 C
[51] Int. Cl.[2] ..... G09F 11/00
[58] Field of Search ..... 40/28 C, 30, 133 A, 40/53 R

[56] References Cited

UNITED STATES PATENTS

| | | | |
|---|---|---|---|
| 2,263,281 | 11/1941 | Von Tadden | 40/28 C |
| 3,357,120 | 12/1967 | Pennington et al. | 40/28 C |
| 3,683,524 | 8/1972 | Polonsky | 40/28 C |
| 3,783,539 | 1/1974 | Trame | 40/28 C |

FOREIGN PATENTS OR APPLICATIONS

| | | | |
|---|---|---|---|
| 194,150 | 1/1908 | Germany | 40/28 C |

*Primary Examiner*—Robert Peshock
*Assistant Examiner*—Wenceslao J. Contreras
*Attorney, Agent, or Firm*—Wheeler, Morsell, House & Fuller

[57] ABSTRACT

An opaque face plate has arrays of openings which are each arranged to form numerals when light is transmitted through a predetermined selection of openings. A plurality of opaque back plates are movably mounted behind the face plate, each back plate having an array of openings positioned to coact with face plate openings to form different numerals depending upon the position of movement of the back plate. Each back plate is driven in an orbital path in a plane parallel to the plane of the face plate by means which includes a slot in the back plate, and cam means coacting with said slot.

7 Claims, 5 Drawing Figures

DISPLAY DEVICE WITH ORBITALLY MOVABLE PLATES

BACKGROUND OF THE INVENTION

This invention relates to display devices in which one or more opaque back plates each having an array of openings therein are moved in an orbital path behind a face plate having an array of openings therein for each back plate, the openings in the face plate and back plates being positioned to coact to form indicia when light is transmitted through a predetermined selection of registering openings in the back plates and face plate. One example of such a display device is disclosed in U.S. Pat. No. 3,783,539 which discloses a digital clock.

In practice, the orbital drive mechanism for the back plates of the above described patent has been found to have a tendency to stick and thereby to stop the clock. The principal object of this invention is to provide an improved orbital drive mechanism which is not subject to sticking and which is more dependable.

Other objects, advantages and features of the invention will be apparent from the disclosure hereof.

SUMMARY OF THE INVENTION

In accordance with this invention, the foregoing object has been attained by providing an orbital drive mechanism which includes a slot in each back panel, a first spur gear rotatably mounted adjacent to each back plate and slot, a cam eccentrically mounted on the gear and engaged in the slot, a second spur gear rotatably mounted adjacent to a portion of the back plate and in mesh with the first spur gear, means eccentrically coupling the second spur gear to another portion of said back plate in a location spaced from the slot, and means for intermittently rotating one of the spur gears to move the back plate in an orbital path.

DESCRIPTION OF THE PREFERRED EMBODIMENT

Figure 1:
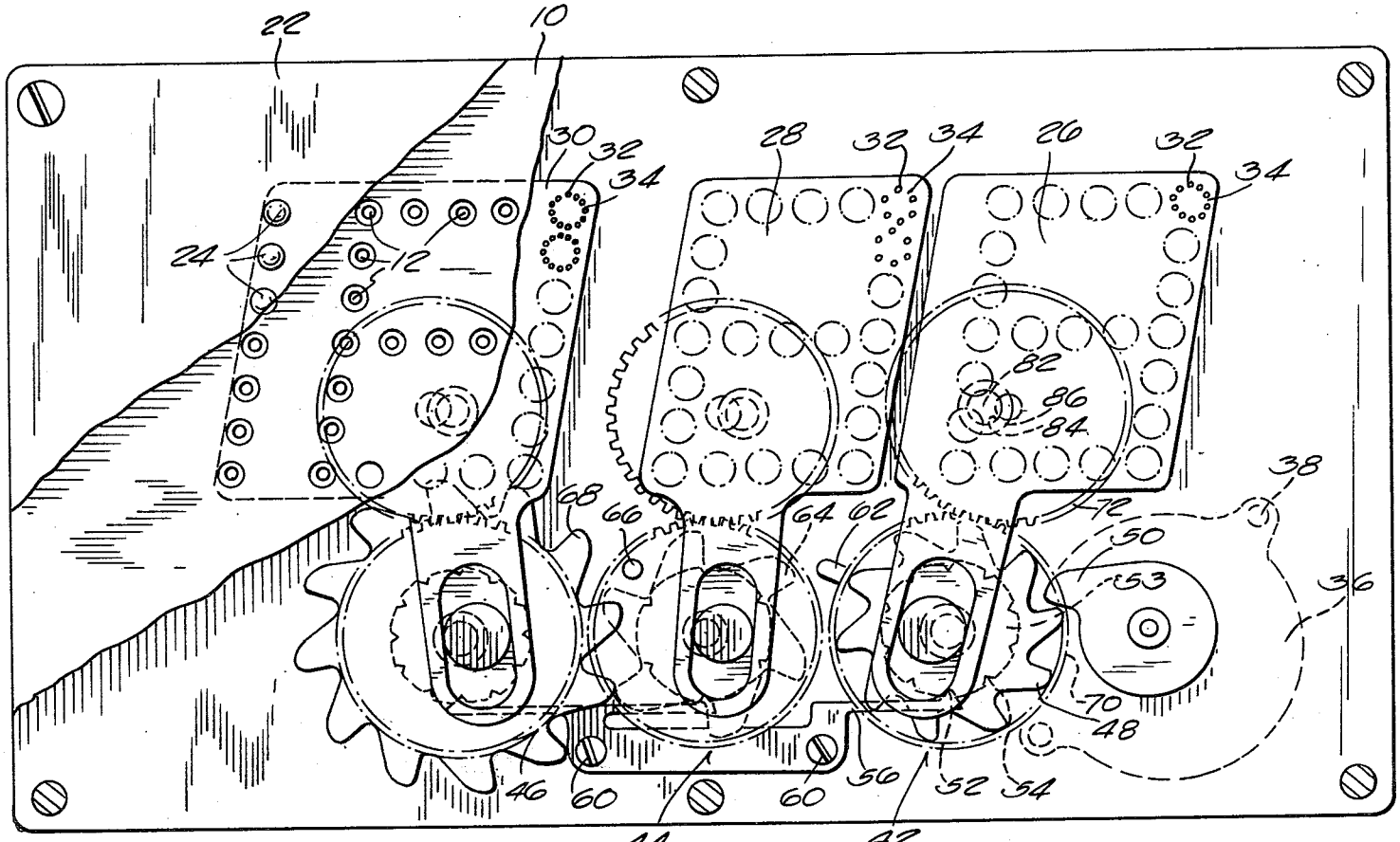
FIG. 1 is a front elevational view, partially cut away, of the preferred embodiment of the invention.
Figure 2:
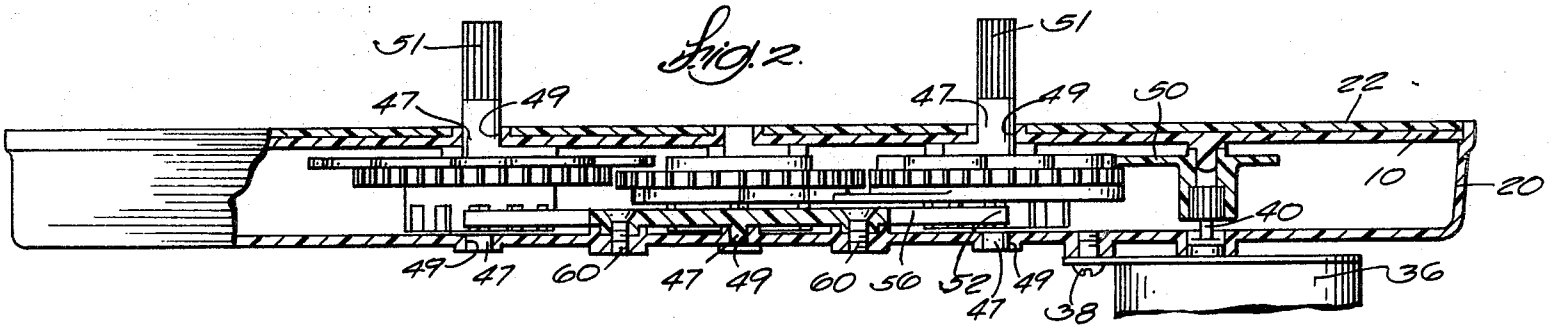
FIG. 2 is a bottom view taken on the line 2—2 of FIG. 1, part of the bottom of the casing being broken away.

This invention is an improvement upon the display device disclosed in U.S. Pat. No. 3,783,539, the disclosure of which is hereby incorporated herein by reference.

The preferred embodiment of this invention includes an opaque face plate 10 which is provided with a plurality of outwardly chamfered holes 12 which are arranged in rectangular arrays to form digits when the appropriate holes 12 are illuminated from the rear. The rectangular arrays represent the time of day in this particular embodiment; however, it should be understood that this invention is not limited to digital displays and that holes 12 could be arranged to represent letters or other suitable indicia.

Face plate 10 is mounted on an open faced, molded transparent plastic housing 20 and has a transparent plastic cover 22 mounted thereover, the latter having arrays of integrally molded lenses 24 (FIG. 3) each of which is positioned over a corresponding hole 12.

Three opaque back plates 26, 28 and 30 (FIG. 1) are movably mounted behind face plate 10 and each contains a plurality of holes 32 which are arranged on small circles 34, each of the holes on the small circles 34 being adapted to cooperate with one of the holes 12.

In the operation of this embodiment, back plates 26, 28 and 30 are each adapted to be moved in a circular orbit which has the same radius as one of the small circles 34, whereby each of the holes 32 will come into registration with the corresponding hole 12 once during each complete orbit of the back plates 26, 28 or 30. Holes 32 of the various circles 34 are adapted to coact with holes 12 to form successive digits as back plates 26, 28 and 30 are moved around their respective orbits. The digits are formed by the pattern of illuminated holes 12 caused by a light source (not shown) behind transparent housing 20, the light passing through the housing and through registering holes 12 and 32 and forming the desired digital pattern. In some embodiments the light source may be suitably located in the housing 20. This method of forming the digits is described in greater detail in the above-noted U.S. Pat. No. 3,783,539.

This invention is concerned with improvements in the means for mounting back plates 26, 28 and 30 and for moving back plates 26, 28 and 30 in the proper orbital path. The back plate 26, which forms the unit digit of the minutes figures, moves in ten steps in an orbital path (one step for each of the numerals 0 to 9). Each step produces an array of illuminated holes 12 that form a corresponding one of the digits 0 to 9. The back plate 28, which forms the tens digit of the minutes representation, moves in six steps in an orbital path (0, 10, 20, 30, 40 and 50 minutes), which steps each produce an array of illuminated holes 12 that form a corresponding one of the digits to represent one of the tenth portions of an hour. The back plate 30, which forms the hours numerals, moves in 12 steps in an orbital path, each step of which produces an array of illuminated holes 12 that form a corresponding one of the numbers 1 to 12, representing the hours.

Back plates 26, 28 and 30 are moved around their orbits one step at a time. Back plate 28 moves one step for each complete orbit (10 increments) of back plate 26, and back plate 30 moves one step for each complete orbit (six increments) of back plate 28. These particular ratios of movement are only true for the illustrated embodiment to produce a digital clock display. In other embodiments, other ratios of movement may be employed.

In the preferred embodiment, the above-described orbital movements are initiated by an electric motor 36 which is mounted on the back of housing 20 by screws 38, and has an output shaft 40 that rotates at a rate of one revolution per minute. The movement of shaft 40 is propagated intermittently along an intermittent movement assembly which includes three wheel assemblies 42, 44 and 46 which are rotatably mounted between face plate 10 and housing 20 by a conventional arrangement of trunnions 47 on the wheel assemblies 42, 44 and 46 which rotate in bearing sockets 49 in face plate 10 and housing 20. The front trunnions 47 of wheel assemblies 42 and 46 extend through face plate 10 and cover plate 22 to form manual adjustment knobs 51 for the digital clock.

Wheel assembly 42 has a cog wheel 48 with ten teeth. A drive finger 50 (FIG. 1) which is rigidly attached to motor shaft 40 is shaped and positioned to rotate cog wheel 48 and wheel assembly 42 by one increment for each complete revolution of shaft 40. Each increment of rotation of cog wheel 48 and wheel assembly 42 is equal to one-tenth of a complete revolution, i.e. 36 degrees. After each increment of rotation, wheel assembly 42 is maintained in indexed position by a detent 52 which coacts with a notched wheel 53 that has one notch 54 for each of the ten rotational increments of wheel assembly 42. Detent 52 is formed on the end of a flexible plastic arm 56 which projects from a plastic plate 58 that is attached to housing 20 by screws 60.

A drive finger 62 is rigidly attached to wheel assembly 42 and rotates therewith. Drive finger 62 coacts with a cog wheel 64 on wheel assembly 44 to rotate wheel assembly 44 by one increment for each complete revolution of wheel assembly 42. Cog wheel 64 has six teeth corresponding to the digits 0 to 5 and rotates 60° for each increment of rotation.

A drive finger 66 is rigidly attached to wheel assembly 44 and rotates therewith. Drive finger 66 coacts with a cog wheel 68 on wheel assembly 46 to rotate wheel assembly 46 by one increment for each complete revolution of wheel assembly 44. Cog wheel 68 has twelve teeth corresponding to the numbers 1 to 12 and rotates 30° for each increment of rotation.

Back plates 26, 28 and 30 are each moved around their orbital paths by the combination of two spur gears and two eccentric couplings linked between the spur gears and the corresponding back plate. The orbital drive means for back plate 26 includes a first spur gear 70 which is rigid with and concentric with wheel assembly 42 to rotate therewith. A second spur gear 72 is journaled to housing 20 by means of a shaft 74 (FIG. 3) which is rigidly attached to spur gear 72 and rotates in a bearing socket 76 formed by a bearing sleeve 77 on the back of housing 20. Spur gear 72 meshes with spur gear 70 and rotates therewith. The gear ratio between spur gear 70 and spur gear 72 is 1:1.

Spur gear 70 is eccentrically coupled to back plate 26 by means of a disc 78 which is eccentrically attached to spur gear 70 and is slideably engaged in an elongated slot 80 in the lower portion of back plate 26. The eccentricity of disc 78 is selected to equal the radius of the desired circular orbit for back plate 26. The diameter of disc 78 is slightly smaller than the width of slot 80.

Spur gear 72 is also eccentrically coupled to back plate 26 by means of a disc 82 which is eccentrically attached to spur gear 72 and is rotatably engaged in a circular opening 84 formed on the back of back plate 26 by an integrally molded ring 86. The eccentricity of disc 82 is also selected to equal the radius of the desired circular orbit for back plate 26. The diameter of disc 82 is slightly smaller than the diameter of socket 84. Disc 82 is held within opening 84 by a lock washer or spring 88 (FIG. 3) which bears on one side on a collar 90 on spur gear 72 and bears on the other side on a collar 92 on the inside end of bearing sleeve 77.

Eccentric discs 78 and 82 apply synchronized eccentric drive to back plate 26 at spaced apart locations so that there is no tendency for back plate 26 to stick as was a problem with the prior art eccentric drives. The same type of novel eccentric drives as described above are provided for back plates 28 and 30, but these will not be described in detail since they have the same structure and function in the same manner as the above-noted eccentric drive for back plate 26.

Figure 4:
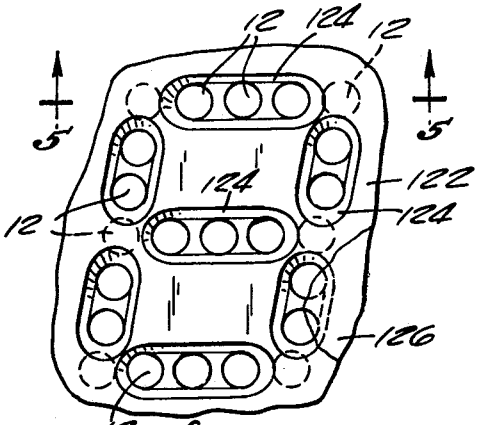
FIG. 4 is a fragmentary elevational view showing a modification.
Figure 5:
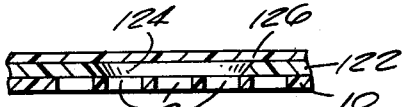
FIG. 5 is a sectional view taken on the line 5—5 of FIG. 4.
Figure 3:
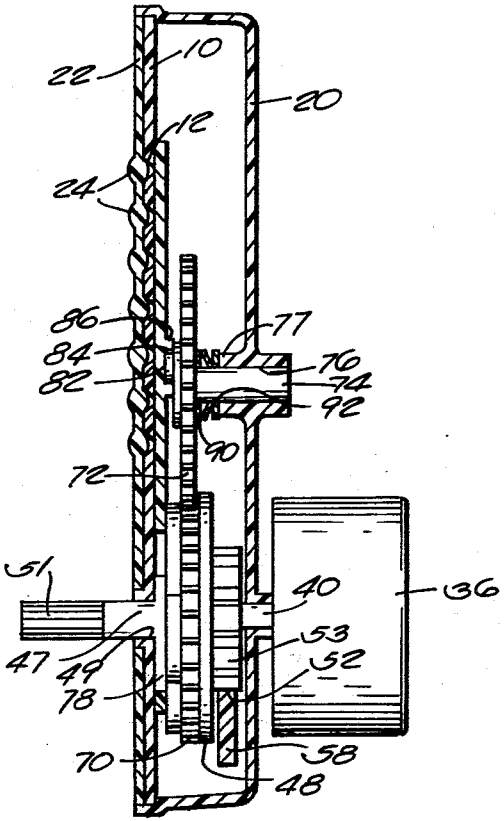
FIG. 3 is a sectional view taken on the line 3—3 of FIG. 1.

The modification of FIGS. 4 and 5 is employed where it is preferred to have the indicia show up as long bars rather than to be visible as an outline of dots. In the modification of FIG. 4, the lens plate 22 of FIG. 3 is omitted and there is substituted over the face plate 10 an opaque panel 122 having horizontal and upright slots 124. This plate 22 is maintained over the face plate so that each of the arrays of dots on the face plate is associated with an array of slots on the panel 122 as shown in FIG. 4. Thus each of the horizontal slots 124 is registered over three of the openings 12 in the face plate, and each of the upright slots 124 is registered over two of the slots 12 of the face plate. The corner dots of each array are hidden as shown in FIG. 4, but the rest of the dots register with slots 124, and the flares at the end of the slots cause spreading of the transmitted light toward the corners. It is preferred to have an outer covering 126 of light-diffusing material as shown in FIG. 5. As a result of this arrangement, the various numerals are displayed through a relatively small group of elongated slots 124 and 125 instead of having the numerals viewed as rows of dot-like openings.

Various changes and modifications may be made without departing from the spirit of the invention, and all of such changes are contemplated as may come within the scope of the claims.

What we claim is:

1. In a display device having an opaque face plate, at least one array of openings formed in said face plate, said openings being arranged to form indicia when light is transmitted through a predetermined group of said openings, an opaque back plate movably mounted adjacent to said face plate, an array of openings formed in said back plate and positioned to coact with the openings in said face plate to form said indicia, and means for orbitally moving said back plate with respect to said face plate, the improvement wherein said means includes a first gear wheel rotatably mounted adjacent to said back plate, a second gear wheel rotatably mounted adjacent to said back plate in mesh with said first gear wheel, first eccentric drive means between said first gear wheel and one portion of said back plate, second eccentric drive means between said second gear wheel and another portion of said back plate which is spaced from said first eccentric drive means, and means for rotating one of said gear wheels to move said back plate in an orbital path.

2. The display device of claim 1 wherein said first eccentric drive means comprises an elongated slot in said back plate and a first disc eccentrically mounted on said first gear wheel and engaged in said slot.

3. The display device of claim 2 wherein said second eccentric drive means comprises a circular opening in said back plate and a second disc eccentrically mounted on said second gear wheel and substantially fitting said circular opening in the back plate to rotate therein.

4. The display device of claim 3 wherein said first disc has a diameter which is slightly smaller than the width of said slot.

5. The display device of claim 3 wherein said back plate is moved in a circular orbit and wherein the eccentricity of the mounting of each disc on its gear is equal to the radius of the orbit through which said back plate is moved.

6. The display device of claim 3 and also comprising spring means urging said second disc into its opening.

7. The display device of claim 3 wherein said circular opening is formed by a ring protruding from the rear face of said back plate.

* * * * *